US006971340B1

(12) United States Patent
Peng et al.

(10) Patent No.: US 6,971,340 B1
(45) Date of Patent: Dec. 6, 2005

(54) COMPRESSION PULSE STARTING OF A FREE PISTON INTERNAL COMBUSTION ENGINE

(75) Inventors: Lixin Peng, Rochester Hills, MI (US); Jing Ping Liu, Rochester Hills, MI (US); Wang Yanmin, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/849,688

(22) Filed: May 20, 2004

(51) Int. Cl.[7] ..... F02B 71/02

(52) U.S. Cl. ..... 123/46 R; 123/179.24; 123/179.31

(58) Field of Search ..... 123/46 R, 46 B, 123/51 R, 51 A, 179.24, 179.31, 185.14

(56) References Cited

U.S. PATENT DOCUMENTS

| | | | | |
|---|---|---|---|---|
| 3,358,656 | A * | 12/1967 | Panhard | 123/179.31 |
| 3,643,638 | A * | 2/1972 | Braun | 123/46 R |
| 3,722,481 | A * | 3/1973 | Braun | 123/46 R |
| 3,769,950 | A * | 11/1973 | Braun | 123/46 R |
| 4,372,256 | A * | 2/1983 | Firey | 123/46 A |
| 4,589,380 | A * | 5/1986 | Coad | 123/46 R |
| 4,694,791 | A * | 9/1987 | Tanaka | 123/179.31 |
| 5,213,067 | A | 5/1993 | Kramer | |
| 5,829,393 | A | 11/1998 | Achten et al. | |
| 6,105,541 | A | 8/2000 | Berlinger | |
| 6,135,069 | A | 10/2000 | Fenelon et al. | |
| 6,158,401 | A | 12/2000 | Bailey | |
| 6,170,443 | B1 | 1/2001 | Hofbauer | |
| 6,206,656 | B1 | 3/2001 | Bailey et al. | |

(Continued)

OTHER PUBLICATIONS

Goertz, et al., SAE Technical Paper Series 00-01-0996, Free Piston Engine Its Application and Optimization, Mar. 6-9, 2000, pp. 1-10.

Peter A.J. Achten, SAE Technical Paper Series 94-1776, A Review of Free Piston Engine Concepts, Sep. 12-14, 1994, pp. 1-12.

*Primary Examiner*—Erick Solis

(74) *Attorney, Agent, or Firm*—David B. Kelley; MacMillan, Sobanskik & Todd

(57) ABSTRACT

A method for starting an engine uses an actuator, such as a hydraulic or pneumatic pump-motor or an electric linear alternator-starter to move the pistons to a position where the inlet ports are opened. This ensures that air is present in the cylinder in a space where fuel will be admitted and combustion will occur. This strategy compresses, with a minimum actuator capacity, such air to a state that the pressure and temperature satisfy the ignition requirements. The air stores kinetic energy of the moving pistons that partially form the air spring force of the opposite cylinder and partially from the actuator. Accumulation, cycle by cycle, of this stored energy accelerates the piston motion, increases the piston displacement, and increases the compression ratio. The cylinder pressure and temperature increas cycle by cycle until the fuel ignition conditions are satisfied. The actuator force is a periodic force preferably having a frequency that is the same or nearly the same as the natural frequency of the system that includes the inertia of the pistons and other masses reciprocating with the pistons and the variable spring, represented by the compressible air spring in the combustion chamber. When piston displacement reaches a sufficient magnitude, fuel is admitted to the air charge, preferably by injection. The actuator continues to increase piston displacement and the compression pressure of the air-fuel mixture in the cylinder until combustion of that mixture in the first cylinder occurs. Fuel is then admitted to the second cylinder while continuing cyclic displacement of the pistons, and combustion of the fuel-air mixture in the second cylinder occurs.

18 Claims, 4 Drawing Sheets

U.S. PATENT DOCUMENTS 6,279,517 B1 8/2001 Achten
6,318,309 B1 11/2001 Burrahm et al.
6,553,966 B2 * 4/2003 Cornell et al. ..... 123/179.1
2003/0051682 A1 3/2003 Achten

* cited by examiner

COMPRESSION PULSE STARTING OF A FREE PISTON INTERNAL COMBUSTION ENGINE

BACKGROUND OF THE INVENTION

The invention relates to starting an internal combustion engine. In particular, the invention pertains to steadily increasing piston displacement, and thus the compression ratio, by applying and increasing a periodic force to a piston reciprocating against a compressible air charge while starting a free piston engine.

A free piston internal combustion engine includes one or more reciprocating pistons located in a combustion cylinder. A crankshaft does not mutually connect the pistons. Instead, each piston moves in response to forces produced by combustion of an air-fuel mixture in a combustion cylinder. Pressure produced by combustion in one cylinder can be used to compress an air-fuel charge in another cylinder. Or an actuating system can be used to compress the air-fuel mixture following the expansion stroke. The actuating system may be used also to reciprocate the piston while starting the engine before combustion of an air-fuel mixture occurs in the cylinder.

Because a free piston engine has no shaft connecting the pistons for coordinating their reciprocation in the cylinders and connecting the pistons to the load, motion of the pistons is controlled by a control system, which synchronizes piston reciprocation, compression of the air-fuel mixture and its combustion. Piston displacement and velocity are monitored and controlled by an actuator system, which periodically corrects deviations from desired, coordinated piston movement.

While starting a free piston engine, the pistons are displaced by a starter system preferably using hydraulic, pneumatic or electric actuation. Preferably, electric energy is used to actuate the piston during starting when the engine produces electric output, and hydraulic or pneumatic energy is used to actuate the piston when the engine produces hydraulic or pneumatic output. When starting the engine, the intake air has a low temperature, but a large compression ratio of the fuel-air charge in the combustion cylinder is required to produce combustion. Therefore, using conventional engine starting techniques, a large magnitude of energy is required to produce the compression ratio required to start the engine, especially under cold starting conditions.

If the engine pistons are driven entirely by an actuator, a large magnitude of energy is required to compress a mixture of fuel and air in the combustion chamber, particularly in a compression ignition engine that requires a high compression ratio for self-ignition to occur. A technique is required to avoid the need for a large capacity energy source to start the engine.

SUMMARY OF THE INVENTION

A free piston engine to which this invention may be applied includes axially-aligned cylinders, an inner pair of mutually connected pistons, and an outer pair of mutually connected pistons. One piston of each piston pair reciprocates in a first cylinder; the other piston of each pair reciprocates in a second cylinder. Each cylinder is formed with inlet ports, through which air enters the cylinder, exhaust ports, through which exhaust gas leaves the cylinder, and a fuel port, through which fuel is admitted, usually by injection, into the cylinder. Movement of the pistons in one cylinder, caused by combustion of a fuel-air mixture there, forces the pistons in the other cylinder to compress a fuel-air mixture in the second cylinder and to cause combustion of that mixture. In this way, the piston pairs reciprocate in the cylinders in mutual opposition, one piston pair moving longitudinal in one direction while the pistons of the other pair move in the opposite direction. When combustion occurs, the direction of movement of each piston pair is reversed until the combustion occurs in the other cylinder.

When an engine is stopped, the piston can be at any position in the cylinder. A free piston engine typically has no inlet valves or exhaust valves to control the flow of air and exhaust gas into and from the cylinder. Instead, the inlet is usually pressurized by a turbocharger driven by the engine exhaust or a supercharge mechanism driven by piston directly. If the engine is stopped with a piston in the compression stroke, leakage of the air charge from the cylinder through the inlet and exhaust ports and across the piston rings will occur during the shutdown period due to the pressure in the cylinder. This leakage can produce a partial vacuum in the cylinder when the piston begins to move in the expansion stroke.

To avoid relying on large hydraulic or pneumatic pressures in the starting actuator a cyclic starting strategy has been developed. The pistons are reciprocated during starting with a progressively increasing displacement (or compression ratio) in order to develop a sufficient magnitude of kinetic energy in the pistons to produce combustion of the fuel-air charge. Energy applied to the piston in each cylinder by a starting actuator and energy recovered from expansion of the compressed charge in the other cylinder before combustion occurs combine to increase the kinetic energy of the reciprocating pistons and to steadily increase pressure in the combustion chamber. During the process, part of the compression energy is transmitted to the compressed air and the energy is increased cycle-by-cycle.

The method for starting the engine uses an actuator, such as a hydraulic or pneumatic pump-motor or an electric linear alternator-starter to move the pistons to a position where the inlet ports are opened. This ensures that air is present in the cylinder in a space where fuel will be admitted and combustion will occur. That air space operates as an air spring during the starting procedure to store kinetic energy from the piston by compressing the air charge during the compression stroke and applying force to piston during the expansion stroke. The pistons reciprocate in response to the application of the actuator force acting against the air charge or spring. The actuator force is a periodic force preferably having a frequency that is the same or nearly the same as the natural frequency of the system that includes the inertia of the pistons and other masses reciprocating with the pistons and the variable spring, represented by the compressible air spring in the combustion chamber. When piston displacement (or compression ratio) reaches a sufficient magnitude, fuel is admitted to the air charge, preferably by injection. The actuator continues to increase piston displacement and the compression pressure of the air-fuel mixture in the cylinder until combustion of that mixture in the first cylinder occurs. Fuel is then admitted to the second cylinder while continuing cyclic displacement of the pistons and combustion of the fuel-air mixture in the second cylinder occurs.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
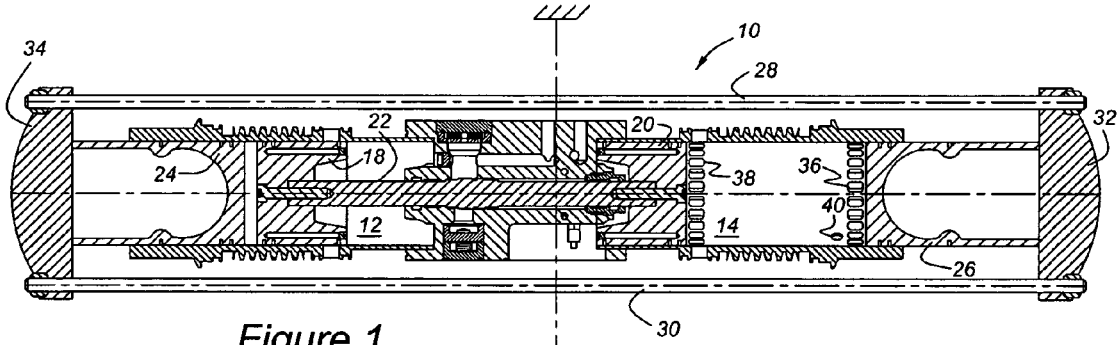
FIGS. 1 and 2 are cross sectional views taken at a longitudinal plane through a free piston engine showing schematically the position of piston pairs and combustion cylinders at opposite ends of their displacement.
Figure 2:
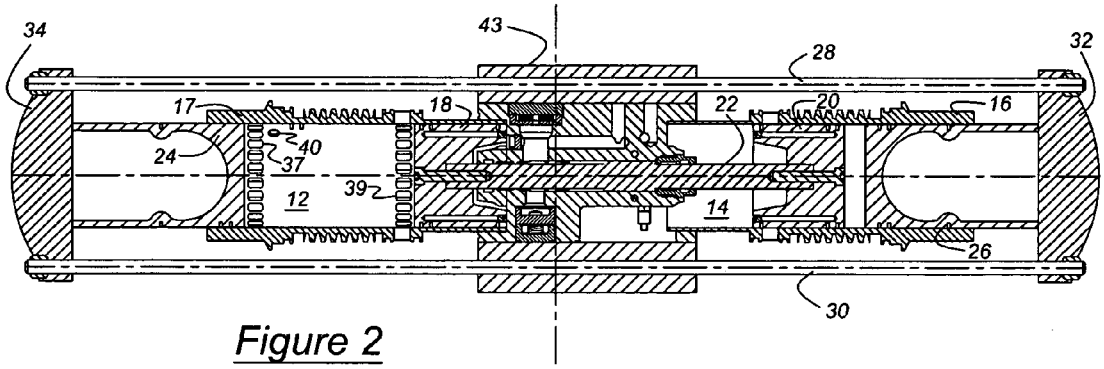

Referring first to FIGS. 1 and 2, a free piston engine 10 includes a first cylinder 12 and a second cylinder 14, axially aligned with the first cylinder, the cylinders being located in cylinder liners or engine blocks 16, 17. A first pair of pistons, inner pistons 18, 20, are mutually connected by a push rod 22. A first piston 18 of the first piston pair reciprocates within the first cylinder 12, and the second piston 20 of the first piston pair reciprocates within the second cylinder 14. A second pair of pistons, outer piston 22, 24, are connected mutually by pull rods 28, 30, secured mutually at the axial ends of pistons 24, 26 by bridges 32, 34. A first piston of the second or outer piston pair reciprocates within the first cylinder 12, and a second piston 26 of the outer piston pair reciprocates within the first cylinder 14. Each cylinder 12, 14 is formed with air inlet ports 36, 37 and exhaust ports 38, 39. In FIG. 1, the ports 37, 39 of cylinder 12 are closed by pistons 18, 24, which are located near their top dead center (TDC) position, and the ports 36, 38 of cylinder 14 are opened by pistons 18, 24, which are located near their bottom center (BDC) position. In FIG. 2, ports 36, 38 of cylinder 14 are closed by pistons 20, 26, which are located near their TDC position, and the ports 37, 39 of cylinder 12 are opened by pistons 18, 24, which are located near their BDC position. When the pistons of either cylinder are at the TDC position, the pistons of the other cylinder are at or near their BDC position. Each cylinder is formed with a fuel port 40, through which fuel is admitted, preferably by injection, into the cylinder during the compression stroke.

Displacement of the piston pairs between their respective TDC and BDC positions, the extremities of travel shown in FIGS. 1 and 2, is coordinated such that a fuel-air mixture located in the space between pistons 18, 24 in cylinder 12 and between pistons 20, 26 in cylinder 14 is compressed so that combustion of those mixtures occurs within the cylinders when the pistons have moved slightly past the TDC position toward the BDC position. This synchronized reciprocation of the piston pairs is referred to as "opposed piston-opposed cylinder" (OPOC) reciprocation.

Figure 3:
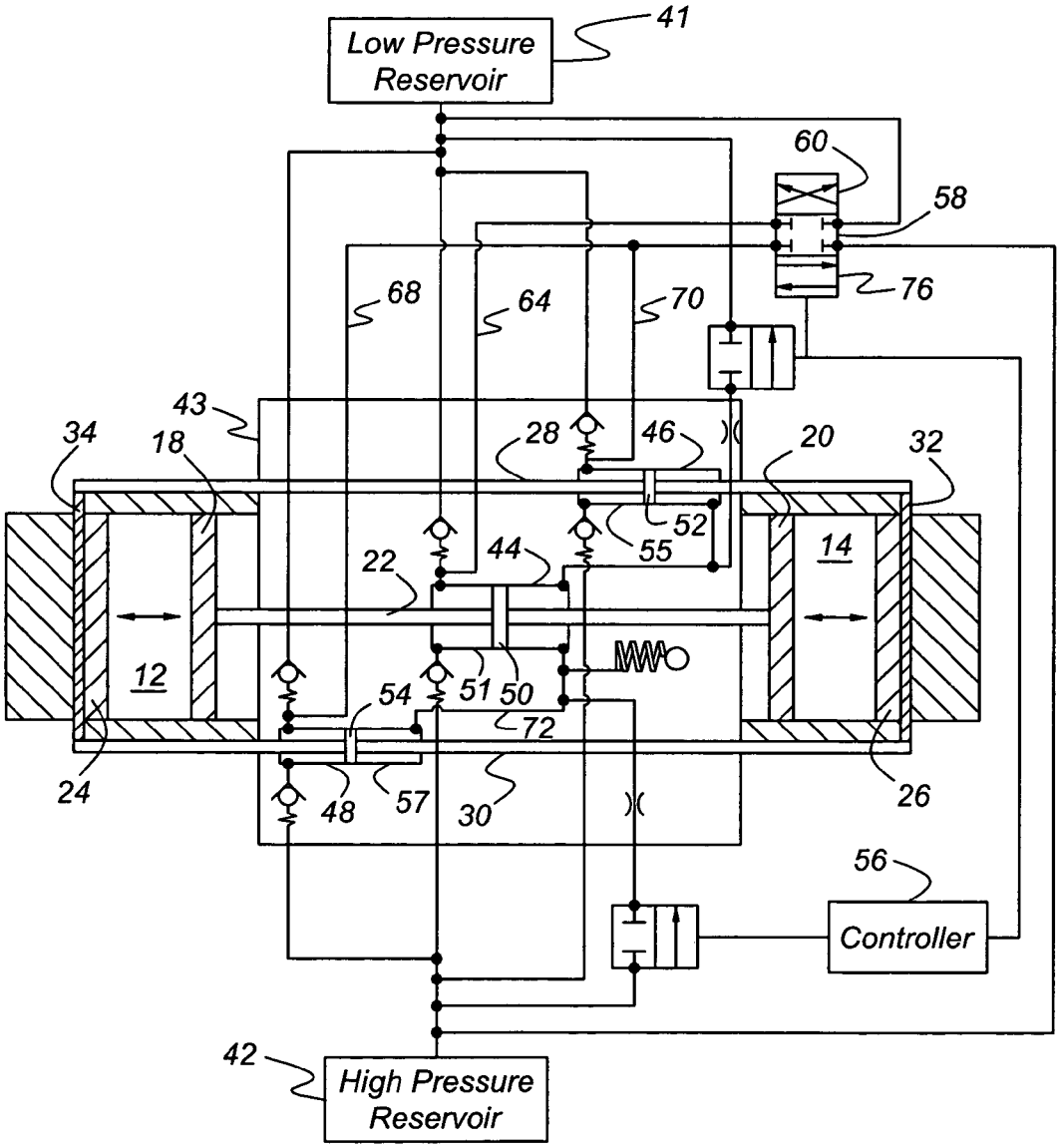
FIG. 3 is a schematic diagram of a fluid control system having a controller for operating fluid pump-motors connected to the engine piston pairs for starting the engine.

The synchronized, coordinated movement of the pistons is controlled through a hydraulic circuit, that includes fluid motor-pumps check valves and lines contained in a hydraulic or pneumatic block 43, located axially between the cylinder sleeves 16, 17. Referring next to FIG. 3, the control circuit includes a low pressure accumulator 41, a high pressure accumulator 42, a motor pump 44 driveably connected to push rod 22, a motor pump 46 driveably connected to pull rod 28, and a motor pump 48 driveably connected to pull rod 30. Push rod 22 is formed with a piston 50 located in a cylinder 51 formed in block 43. Reciprocation of engine pistons 18, 20 causes piston 50 of motor pump 44 to reciprocate. Pull rods 28, 30 are each formed with pistons 52, 54, located in cylinders 55, 57, respectively, formed in block 43. Reciprocation of engine pistons 24, 26 causes pistons 52, 54 of motor pumps 46, 48 to reciprocate.

When the engine 10 is running, the coordinated reciprocating movement of the engine pistons draws fluid from the low pressure accumulator 41 to the pump motors 44, 46, 48, which produce hydraulic or pneumatic output fluid flow, supplied to the high pressure accumulator 42. The motor-pumps 44, 46, 48 operate as motors driven by pressurized fluid in order to start the engine, and operate as pumps to supply fluid to the high pressure accumulator for temporary storage there or to supply fluid directly to fluid motors located at the vehicle wheels, which drive the wheels in rotation against a load.

An electronic controller 56 produces an actuating signal transmitted to a solenoid or a relay, which, in response to the actuating signal, changes the state of a control valve 58. For example, when the hydraulic system is operating as a motor to move the engine pistons preparatory to starting the engine or while the engine is being started, controller 56 switches valve 58 between a first state 60, at which accumulator 42 is connected through valve 58 to the left-hand side of the cylinder 51 of pump-motor 44 through line 64. With valve 58 in the state 60, the left-hand sides of the cylinders 55, 57 of motor-pumps 46, 48, are connected through lines 68, 70 and valve 58 to the low pressure accumulator 41. These actions cause piston 50 to move rightward forcing fluid from pump-motor 44 through line 72 to the right-hand side of the cylinder 57, and through line 74 to the right-hand side of cylinder 55. In this way, the first state of valve 58 causes the fluid control system to move engine pistons 18, 20 rightward and engine pistons 24, 26 to move leftward from the position shown in FIG. 3.

When controller 56 switches valve 58 to the second state 76, high pressure accumulator 42 is connected through line 68 to the left-hand side of piston 57 of motor-pump 48, and through line 70 to the left-hand side of piston 55 of motor-pump 46. This forces engine pistons 24, 26 rightward. When valve 58 is in the second state 76, the low-pressure accumulator 41 is connected through valve 58 and line 64 to the left-hand side of cylinder 51 of motor-pump 44. As pistons 52, 54 move rightward, fluid is pumped from cylinders 55, 57 through lines 74, 72, respectively, to the right-hand side of cylinder 51. This causes piston 50, push rod 22 and engine pistons 18, 20 to move leftward.

To start the engine 10, before fuel is injected, pistons 18, 20 are moved leftward and pistons 24, 26 are moved rightward by the actuator system, described with reference to FIG. 3, toward the position shown in FIG. 1. This causes the pistons to open the inlet ports 36 in cylinder 14, thereby ensuring that cylinder 14 is filled with a pneumatic charge. Next, pistons 18, 20 are moved rightward and pistons 24, 26 are moved leftward by the actuator system toward the position shown in FIG. 2. This causes the pistons to open the inlet ports 37 in cylinder 12, thereby ensuring that cylinder 12 is filled with a pneumatic charge.

After the pistons are filled with a pneumatic charge, the actuation system reciprocates the pistons with continually increasing displacement, or length of stroke, in each cycle. The actuator connects high pressure accumulator 42 alternately to actuator motors 44, 46, 48 in order to displace the piston pairs 18–20, 24–26 in their respective cylinders 12, 14. Preferably the actuator motors 44, 46, 48 apply force to the pistons when the pistons are at or near the BDC position, and the motors remove the actuating force before the piston reaches the TDC position. The pressure developed in each cylinder during its compression stroke forces the piston away from the TDC position during the expansion stroke. The increase of piston displacement for each piston displacement cycle is accomplished by progressively increasing the magnitude of the pressure applied by the actuator motors during each displacement cycle, or by increasing the length of the period when pressure is applied to the actuator, or by a combination of these actions.

Cyclic compression and expansion of the pneumatic charges in cylinder 12, 14 are analogous to the effect of a compression spring located in each cylinder. Compression of the pneumatic charge in a cylinder opposes acceleration of the piston masses toward the TDC position in that cylinder; expansion of the pneumatic charge in a cylinder assists in accelerating the piston masses toward the BDC position in that cylinder. As the charge in one cylinder is being compressed, the charge in the other cylinder is expanding. Therefore, pressure forces are continually developed that assist the pistons in each cylinder to move alternately to the TDC and BDC positions in the correct phase relationship.

Pistons 18, 24 move rapidly in cylinder 12 due to combustion in cylinder 14. An engine controller causes a fuel injector to inject an appropriate quantity of fuel into cylinder 12 between pistons 18, 24 through fuel port 40, thereby starting the engine. After the engine starts, it continues to run under programmed control with fuel injection being actively controlled by an engine controller.

Figure 4:
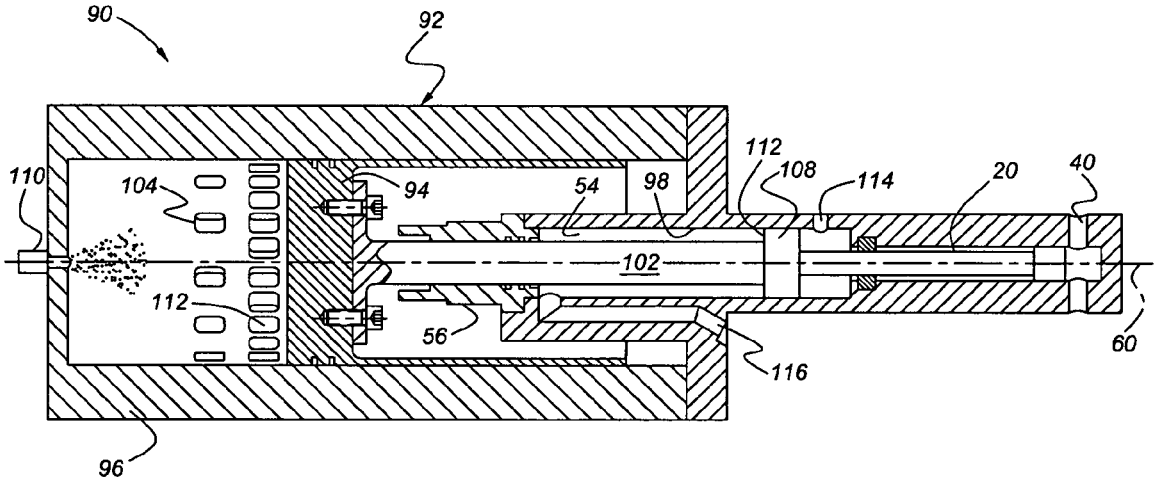
FIG. 4 is a cross sectional schematic diagram of a free piston engine having a single piston reciprocating in each cylinder and an actuator for starting the engine.

FIG. 4 shows a free piston engine 90 that includes a housing 92, a piston 94 reciprocating in a combustion cylinder 96, a compression cylinder 98 and a load 100 secured by a shaft 102 to the piston. Air enters the cylinder through air inlet ports 102, and exhaust gas leaves the cylinder through exhaust ports 104. Air is carried through inlet ports 102 into combustion cylinder 96 when piston 90 nears its BDC position. As piston 90 moves toward its TDC position, fuel is injected into combustion cylinder 96 by a fuel injector operating under control of a fuel control system 110.

Piston 94 is supported for reciprocal linear displacement in the combustion cylinder 96. An engine starting system for actuating the piston includes an actuator piston head 108 attached to shaft 102 located in cylinder 98 for movement with the piston 94. Fluid ports 114 and 116 carry pressurized fluid into cylinder 98 from opposite sides of piston head 108. A pressure force, produced by pressurized fluid in cylinder 98, causes piston head 108 and piston 94 to move toward the TDC position during the compression stroke. Pressurized fluid entering cylinder 98 through fluid port 116 causes piston head 108 and piston 94 to move toward the BDC position while the engine is being started or if the engine misfires.

To start the engine 90, after an ignition switch is turned ON and before fuel is injected, piston 94 is moved by the actuator system toward the BDC position sufficiently to open the inlet ports 102, thereby ensuring that cylinder 96 is filled with a pneumatic charge. Then, the actuation system causes piston 94 to reciprocate in cylinder 96 with continually increasing displacement amplitude in each displacement cycle. The increase of piston displacement is accomplished by progressively increasing the magnitude of the pressure applied to actuator head 108 during each displacement cycle, or by increasing the length of the period when pressure is applied to head 108, or by applying pressure alternately to both sides of head 108, or by a combination of these actions. Cyclic compression and expansion of the pneumatic charge is analogous to storing and releasing energy in a compression spring that opposes acceleration of the piston mass toward the TDC position and releases the stored spring energy to acceleration of the piston mass toward the BDC position. The actuation system provides a force that accelerates the piston toward the TDC position.

After the head of piston 94 reaches a predetermined position in the combustion cylinder during this reciprocation cycling procedure, or when a predetermined compression ratio in cylinder 96 is reached, or when pressure in compression cylinder 96 reaches a predetermined magnitude, fuel is injected into cylinder 96 in a suitable volume to produce combustion and to start the engine 90.

Figure 5:
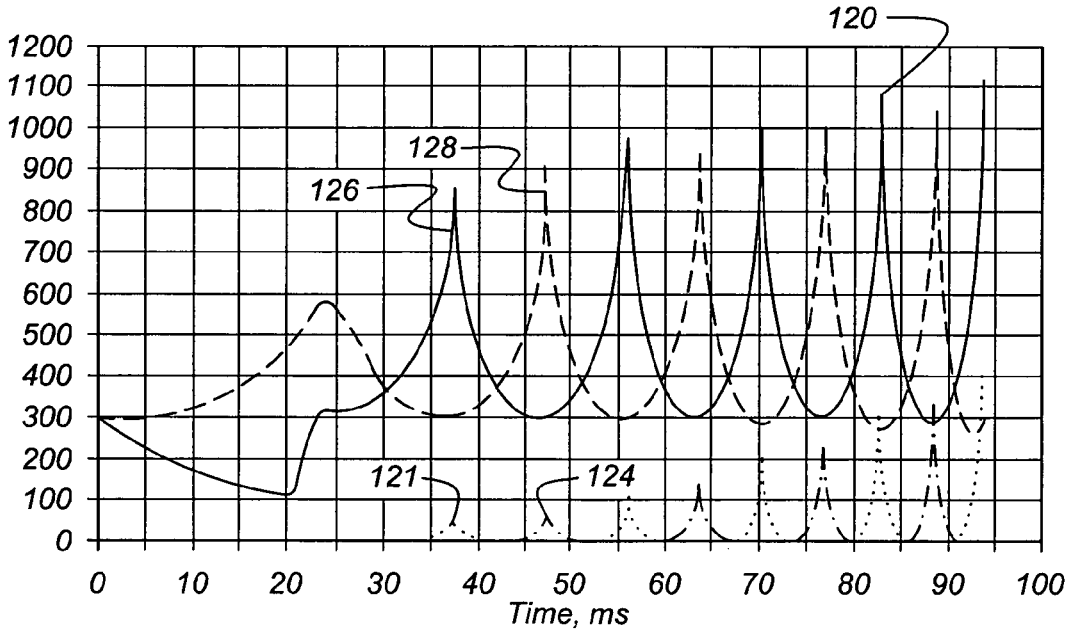
FIG. 5 is a graph that shows the variation with time of cylinder pressure and piston displacement using the method of this invention to start an engine.

FIG. 5 shows the variation with time of pressure 121, 122 in each of the cylinders 12, 14, respectively, and displacement 126, 128 of the piston pairs 18–20, 24–26 as engine 10 is started using the method of this invention. The maximum cylinder pressure and maximum piston displacement increase for each cycle. Piston velocity increases for each cycle also, as can be seen by the steady decrease in the length of the piston period between successive cycles. Ignition of the fuel-air mixture in a cylinder occurs at 120.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A method for starting a free piston internal combustion engine that includes a combustion cylinder, a piston located in the cylinder, an inlet port through which air enters the cylinder and that can be closed and opened by the piston as the piston moves in the cylinder, and a actuator for displacing the piston in the cylinder, the method comprising the steps of:

using the actuator to displace the piston sufficiently to open the inlet port and supply an air charge to the cylinder;

using the actuator to apply a periodic force to the piston and cyclically to increase pressure of the air charge without opening the inlet port as the pressure of the air charge cyclically increases; and producing a fuel-air mixture in the cylinder by admitting fuel to the air charge.

2. The method of claim 1, wherein the step of producing a fuel-air mixture further comprises:

determining, based at least on the pressure of the air charge, a volume of fuel that would result in combustion of a fuel-air mixture containing the volume of fuel; and admitting said volume of fuel to the air charge.

3. The method of claim 1, further comprising:

determining a magnitude of piston displacement at which combustion of the fuel-air mixture would occur after admitting fuel to the air charge; and using the actuator to apply a periodic force to the piston and cyclically to increase displacement of the piston to said magnitude of piston displacement.

4. The method of claim 1, further comprising:

determining a magnitude of air charge pressure at which combustion of the fuel-air mixture would occur after admitting fuel to the air charge; and using the actuator to apply a periodic force to the piston and cyclically to increase pressure of the air charge to said magnitude of air charge pressure.

5. The method of claim 1, further comprising:

determining a magnitude of an air charge compression ratio at which combustion of the fuel-air mixture would occur after admitting fuel to the air charge; and using the actuator to apply a periodic force to the piston and cyclically to increase the compression ratio of the air charge to said magnitude of air charge compression ratio.

6. The method of claim 1, further comprising:

determining a magnitude of piston velocity at which combustion of the fuel-air mixture would occur after admitting fuel to the air charge; and using the actuator to apply a periodic force to the piston and cyclically to increase the velocity of the piston to said magnitude of piston velocity.

7. A method for starting a free piston internal combustion engine that includes a first pair of mutually connected pistons, a second pair of mutually connected pistons, a first piston of each pair moving in a first cylinder, a second piston of each pair moving in a second cylinder, each cylinder having a inlet port through which air enters the cylinder and that is closed and opened by a piston moving in the cylinder, and a actuator for displacing the pistons, the method comprising the steps of:

supply an air charge in a space between the pistons in each cylinder;

using the actuator to apply a periodic force to a piston to reciprocate the pistons and cyclically to increase pressure of the air charges; and producing a fuel-air mixture in a cylinder by admitting fuel to an air charge.

8. The method of claim 7 further comprising:

continuing to use the actuator to increase pressure in the space until combustion of the fuel-air mixture occurs;

repeatedly supplying fuel periodically into the space until repeated combustion of the fuel-air mixture is sustained; and discontinuing use of the actuator to reciprocate the pistons.

9. The method of claim 7, wherein the step of supply an air charge further comprises:

using the actuator to displace the pistons sufficiently to open communication between the inlet ports and said space.

10. The method of claim 7, wherein the step of producing a fuel-air mixture further comprises:

determining, based at least on the pressure of an air charge, a volume of fuel that would result in combustion of a fuel-air mixture containing the volume of fuel; and admitting said volume of fuel to an air charge.

11. The method of claim 7, further comprising:

determining a magnitude of piston displacement at which combustion of the fuel-air mixture would occur after admitting fuel to an air charge; and using the actuator to apply a periodic force to a piston and cyclically to increase displacement of a piston to said magnitude of piston displacement.

12. The method of claim 7, further comprising:

determining a magnitude of air charge pressure at which combustion of the fuel-air mixture would occur after admitting fuel to an air charge; and using the actuator to apply a periodic force to a piston and cyclically to increase pressure of an air charge to said magnitude of air charge pressure.

13. The method of claim 7, further comprising:

determining a magnitude of air charge compression ratio at which combustion of the fuel-air mixture would occur after admitting fuel to an air charge; and using the actuator to apply a periodic force to a piston and cyclically to increase a compression ratio of an air charge to said magnitude of air charge compression ratio.

14. The method of claim 7, further comprising:

determining a magnitude of piston velocity at which combustion of an fuel-air mixture would occur after admitting fuel to an air charge; and using the actuator to apply a periodic force to a piston and cyclically to increase a velocity of a piston to said magnitude of piston velocity.

15. The method of claim 7, wherein the step of using the actuator to apply a periodic force to a piston further comprises:

determining a length of a period of piston displacement; and using the actuator to apply to a piston a force having a period that is substantially equal to the determined period of piston displacement.

16. A method for starting a free piston internal combustion engine, comprising the steps of:

providing a first pair of mutually connected pistons, a second pair of mutually connected pistons, a first piston of each pair moving in a first cylinder, a second piston of each pair moving in a second cylinder, each cylinder having a inlet port through which air enters the cylinder, and a actuator for displacing the pistons;

opening the inlet ports to admit an air charge to a space between the pistons in each cylinder;

closing the space between the pistons in each cylinder while starting the engine;

applying a periodic force to a piston to reciprocate the pistons and cyclically to increase pressure in the space;

using pressure in the space cyclically to assist and to oppose piston reciprocation; and supplying fuel periodically into the space occupied by an air charge to produce a fuel-air mixture.

17. The method of claim 16 further comprising:

continuing to reciprocate a piston to increase pressure in the space until combustion of the fuel-air mixture occurs.

18. The method of claim 16 further comprises continuing to reciprocate a piston to increase pressure in the space until combustion of the fuel-air mixture occurs; and repeatedly supplying fuel periodically into the space until repeated combustion of the fuel-air mixture is sustained.

* * * * *